United States Patent [19]

Lawler

[11] 4,205,818

[45] Jun. 3, 1980

[54] MUSICAL INSTRUMENT STAND

[76] Inventor: Frederick D. Lawler, 73 Malden Ave., La Grange, Ill. 60525

[21] Appl. No.: 1,951

[22] Filed: Jan. 8, 1979

[51] Int. Cl.[2] ..... A47B 97/04

[52] U.S. Cl. ..... 248/460; 248/174; 211/13

[58] Field of Search ..... 248/460, 174, 165; 297/442, 186, 187, 439; 211/13; 84/327

[56] References Cited

U.S. PATENT DOCUMENTS

| | | | |
|---|---|---|---|
| 1,273,239 | 7/1918 | Leon et al. | 248/460 |
| 1,301,797 | 4/1919 | Ziegler | 248/174 X |
| 1,402,483 | 1/1922 | Evans | 248/460 |
| 1,655,331 | 1/1928 | Norman | 248/165 X |
| 1,684,912 | 9/1928 | Dunklau | 211/13 |
| 2,058,184 | 10/1936 | Sherrard | 211/13 |
| 3,057,591 | 10/1962 | Weimer | 248/460 X |
| 3,282,437 | 11/1966 | Hansen | 248/460 |
| 3,341,162 | 9/1967 | Ruchlis | 248/174 |
| 3,593,955 | 7/1971 | Hind | 248/460 |
| 3,606,458 | 9/1971 | Attinger | 297/439 |

*Primary Examiner*—Francis K. Zugel
*Attorney, Agent, or Firm*—Marshall A. Burmeister; Foster York; Francois N. Palmatier

[57] ABSTRACT

A stand is adapted to support a musical instrument, such as a guitar, in an upright manner and is adapted to be assembled or disassembled in a rapid and convenient manner. The stand includes a pair of spaced-apart upright L-shaped members inclined toward one another. The members include forwardly projecting spaced-apart foot portions for supporting the bottom portion of the musical instrument. Strut members extend between the L-shaped members to help rigidify them. A support device releasably attached to the upper portion of at least one of the L-shaped members supports the upper portion of the musical instrument. The support device is also adapted to support sheet music, and a foot rest is provided and swings between a horizontal use position for receiving and supporting the foot of the user during the playing of the musical instrument and a generally vertical position behind and out of the way of the musical instrument when it is resting on the stand.

6 Claims, 4 Drawing Figures

MUSICAL INSTRUMENT STAND

The present invention relates in general to a musical instrument stand, and it more particularly relates to a stand which is readily and conveniently assembled and disassembled.

There have been many different types and kinds of musical instrument stands and support devices. For example, reference may be made to the following U.S. Pat. Nos. 1,170,684; 1,342,136; 2,163,859; 2,901,860; 3,282,437; and 3,593,955. While such devices as disclosed in the foregoing-mentioned patents have been satisfactory for some applications, it would be highly desirable to have a musical instrument stand, which can be conveniently assembled and disassembled in an easy and convenient manner and which can be readily transported in a knocked-down form. Such a musical instrument stand should be useful for different kinds of musical instruments, such as guitars, for supporting them in a substantial vertical position when not in use. Such a stand should also be useful to support sheet music while the performer is playing the musical instrument. Also, such a stand should be adapted to support the foot of the user while the user is playing the musical instrument, such as a guitar, in a seated position resting the instrument on the user's leg. Such a musical instrument support stand should be relatively inexpensive to manufacture and asethically pleasing in appearance.

The principal object of the present invention is to provide a new and improved musical instrument stand, which can be readily assembled and disassembled for transporting it in its knocked-down form.

Another object of the present invention is to provide such a new and improved musical instrument stand, which is also adapted to support sheet music as well as the foot of the user during the playing of the musical instrument.

Briefly, the above and further objects of the present invention are realized by providing a stand which is adapted to support a musical instrument in an upright manner and includes a pair of spaced-apart upright L-shaped members inclined toward one another. The members include forwardly projecting spaced-apart foot portions for receiving and at least partially supporting the bottom portion of the musical instrument. Strut members extend between and are releasably connected to the L-shaped members to help rigidify them. A support device is releasably attached to the upper portion of at least one of the L-shaped members for supporting the neck portion of the musical instrument. The support device is also adapted to support sheet music, and, at the lower portion of the stand, a foot rest is swingably connected to the L-shaped members to move between a horizontal use position and a vertical storage position out of the way of the musical instrument when it is supported by the stand.

The invention, both as to its organization and method of operation, together with further objects and advantages thereof, will best be understood by reference to the following detailed description taken in connection with the accompanying sheet of drawings, wherein.

Figures 1, 2, 3, 4:
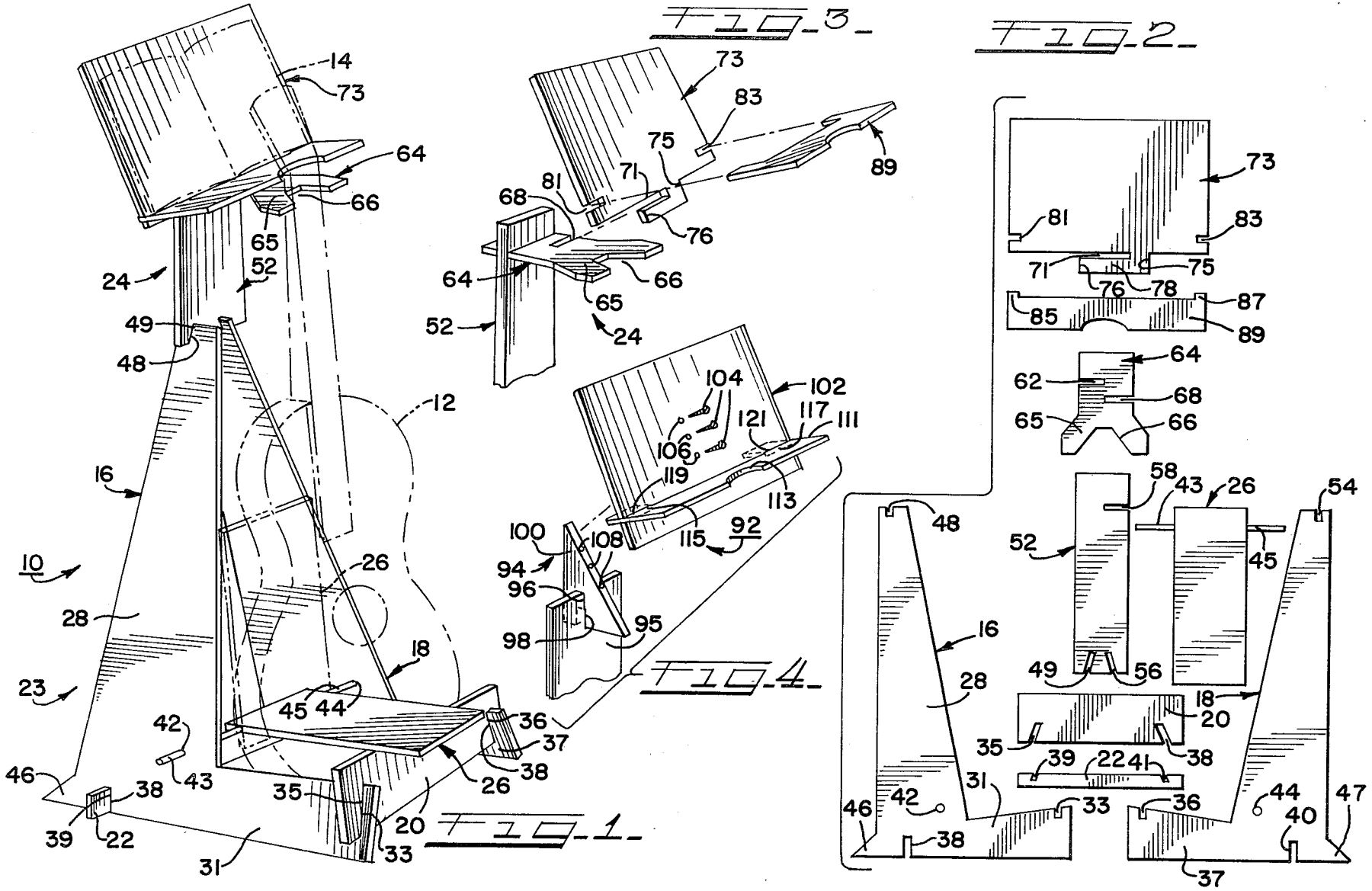
FIG. 1 is a pictorial view of the musical instrument support stand, which is constructed in accordance with the present invention and which is illustrated supporting a musical instrument in the form of a guitar shown in phantom lines.
FIG. 2 is a knocked-down plan view of the stand of FIG. 1 showing it in a disassembled form.
FIG. 3 is a fragmentary exploded pictorial view of the upper portion of the stand of FIG. 1.
FIG. 4 is a fragmentary exploded pictorial view of the upper portion of another musical instrument stand, which is also constructed in accordance with the present invention.

Referring now to the drawings, and more particularly to FIG. 1 thereof, there is shown a musical instrument stand 10, which is constructed in accordance with the present invention, and which is adapted to support in a generally upright manner a musical instrument, such as the guitar 12 as shown in phantom lines. Sheet music 14 may also be supported by the stand 10 as indicated in the phantom line showing thereof. As hereinafter described in greater detail, the musical instrument stand 10 may be readily assembled and disassembled in a convenient manner. Once assembled, as shown in FIG. 2, the stand 10 can be transported in knocked-down form.

The musical instrument stand 10 generally comprises a pair of upright L-shaped members 16 and 18 which are inclined toward one another and are rigidified at their lower portions by means of a pair of front and rear transversely-extending struts 20 and 22 to form a base generally indicated at 23. A support device or subassembly generally indicated at 24 is mounted on top of the base 23 formed of the L-shaped members for supporting the neck of the guitar 12 and the sheet music. A foot rest 26 extends between the L-shaped members 16 and 18 and swings adjustably from the horizontal use position as indicated in solid lines in FIG. 1 of the drawings upwardly and backwardly into the generally vertical storage position as indicated in broken lines in FIG. 1 disposed behind the musical instrument 12 when it is resting on the stand 10.

Considering now the L-shaped members 16 and 18 in greater detail with reference to FIGS. 1 and 2 of the drawings, the left-hand L-shaped member 16 will now be described in greater detail, it being understood that the right-hand L-shaped member 18 is similar to it. The L-shaped member 16 includes a leg portion 28 which is tapered from its narrow upper end and gradually enlarges to its lower end at a forwardly projecting foot portion 31, the leg portion 28 being tapered as a result of the front side edge being inclined rearwardly. An upwardly extending notch or open slot 33 is disposed at the outermost portion of the foot portion 31 receiving and interconnecting with a downwardly extending notch or open slot 35 in the front strut 20. A corresponding upwardly facing notch or open slot 36 in a foot portion 37 of the L-shaped member 18 receives a downwardly extending notch or open slot 38 at the other end of the strut 20. A downwardly depending notch or open slot 38 is disposed at the rear portion of the foot portion 31 for receiving and interconnecting with an upwardly extending notch or open slot 39 in the rear strut 22. Similarly, the downwardly depending notch or open slot 40 at the rear portion of the foot 37 of the L-shaped member 18 interengages with an upwardly extending notch or open slot 41 at the right-hand end of the rear strut 22.

In order to support swingably the foot rest 26, a hole 42 in the lower portion of the leg portion 28 receives a pivot rod 43 extending from the rear side edge of the foot rest 26, and a similar hole 44 in the L-shaped member 18 receives a pivot rod 45 extending from the right hand rear side edge of the foot rest 26. As a result, the foot rest 26 pivots about the axis of the aligned rods 43 and 45 from the position as shown in solid lines in FIG. 1 of the drawings to a position as shown in broken lines for permitting the storage of the guitar 12. Since the L-shaped members 16 and 18 are inclined toward one another, the axes of the holes 42 and 44 are inclined at a slight angle relative to the faces of the respective members 16 and 18 so that the rods 43 and 45 are co-axially aligned in a horizontal disposition. The foot rest 26 is generally rectangular in shape, and the front end portion thereof rests on the upper edge of the front strut 20 when the foot rest is disposed in a horizontal position. The foot rest 26 is inclined slightly rearwardly when in its generally vertical position resting against the front edges of the converging L-shaped members 16 and 18.

A triangularly-shaped integral heel portion 46 extends rearwardly at the rear end of the foot portion 31 to help provide stability for the stand 12. Similarly, a triangularly-shaped heel portion extends from the rear end of the foot 37 of the L-shaped member 18.

An upwardly extending notch or open slot 48 at the upper portion of the leg portion 28 receives and is interconnected with a downwardly depending notch or open slot 49 in a vertical elongated upright member 52 of the support 24. Similarly, an upwardly extending notch or open slot 54 in the upper portion of the L-shaped member 18 receives and interconnects with a downwardly extending notch or open slot 56 in the bottom end of the upright member 52 and spaced apart from and inclined upwardly toward the notch 49. Near the upper end portion of the upright member 52 at the right-hand edge thereof, a horizontal notch or open slot 58 receives and interconnects with a horizontal notch or open slot 62 in the left-hand edge at the rear portion of a generally horizontal guitar-neck supporting forwardly-projecting member 64, which includes an enlarged front end portion having an open slot or notch 66 disposed therein for receiving the neck portion of the guitar 12. A horizontal notch or open slot 68 in the right-hand edge of the guitar-neck supporting member 64 is disposed between the notch 62 and the open slot 66 for receiving and interconnecting with a horizontal notch or open slot 71 in the left-hand edge of an upright slightly backwardly inclined music sheet back rest member 73 which is used to support the sheet music 14 as best seen in FIG. 2 of the drawings. A pair of cut-off bottom corner portions 75 and 76 together with the slot 71 define a leftwardly extending tail portion 78 which is substantially the same width as the width of the member 64. A pair of horizontal notches or open slots 81 and 83 in the respective opposite left and right side edges of the lower portion of the member 73 are adapted to receive a pair of rearwardly extending ears 85 and 87 respectively of a generally horizontally extending elongated sheet-music support member 89, which is adapted to support from below the sheet music 14 as it rests in a slightly inclined rearward manner as indicated in FIG. 1. In this regard, the member 89 extends transversely from the front face of the member 73.

Each one of the components of the stand 10 is composed of a thin flat rigid material, such as suitable plywood material. Thus, when the stand 10 is disassembled completely, as shown in FIG. 2 of the drawings, the components can be stacked one on top of the other in a compact manner for storage or transportation purposes.

In order to assemble the stand 10, the L-shaped members 16 and 18 are held in an upright manner, and the rods 43 and 45 of the foot rest member 26 are slipped through the respective holes 42 and 44 in the members 16 and 18. The front strut 20 is positioned above the foot portions 31 and 37 with the notches 35 and 38 disposed opposite the respective notches 33 and 36 in the foot portions. The strut 20 is then lowered into position to cause the notches in the strut to interengage with the notches in the upper foot portions near the fronts thereof. Similarly, the rear strut 22 is attached to the rear portions of the underside of the foot portions by interengaging the respective slots therein.

The horizontal member 52 is then attached to the upper ends of the L-shaped members by interengaging the notches 49 and 56 with the corresponding notches 49 and 56 with the corresponding notches 48 and 54 at the upper edges of the L-shaped members 16 and 18 respectively. The neck-supporting member 64 is then attached to the upright member 52 by holding the member 64 horizontally with its rear notch 62 opposite the upper notch 58 in the right side of the upright member 52, so that the notches can be moved into interengaging relationship by a sideward movement of the member 64 toward the member 52. As a result, the member 64 projects forwardly from the upright member 52 for supporting the upper portion of the guitar 12. The music sheet back rest member 73 is then positioned in a backwardly inclined disposition and moved until its lower notch 71 interengages with the intermediate notch 68 of the horizontal member 64 for supporting the member 73 thereon. The music sheet support member 89 is held transversely to the plane of the face of the generally rectangular music back rest member 73 and moved toward the member 73 until the ears 85 and 87 move into engagement with the respective slots 81 and 85.

It should be noted that, if desired, the back rest member 73 and the support member 89 may not be used where there is no necessity of supporting sheet music with the stand 12 so that the stand 10 can serve as a guitar stand only.

The stand 10 is disassembled by a reverse process. Thus, both the assembly and disassembly is accomplished with relatively uncomplicated manipulations in a short period of time.

Referring now to FIG. 4 of the drawings, there is shown a musical instrument stand 92 which is also constructed in accordance with the present invention. The stand 92 is similar to the stand 10 except that the stand 92 is somewhat easier to assemble, but it can be used only as a combination instrument and music stand and not a guitar stand only as is the case of the stand 10. The stand 92 generally comprises a base portion (not shown) which is similar to the base portion 23 of the stand 10, and a support device 94, which is similar to the support 24. The support device 94 includes an upright member 95 which is similar to the upright member 52, and which includes an upwardly extended notch or open slot 96 in the upper edge of the member 95 for interengaging with a downwardly depending notch or open slot 98 in the bottom edge of triangularly-shaped member 100. The back face of a music sheet back rest member 102 is fastened to the sloping edge of the triangular member 100 by means of a series of wood screws 104 extending through a series of spaced-apart holes 106 aligned with corresponding holes 108 in the inclined edge of the triangular member 100. The music sheet support member 111 extends transversely to and projects forwardly from the plane of the music sheet rest member 100 in a similar manner as the support member 89 projects from the rest member 73. A guitar neck-engaging open notch or slot 113 is disposed intermediate the ends of the support member 111 for receiving and supporting the neck portion of a guitar (not shown) or other such similar musical instrument. A pair of rearwardly extending ears 115 and 117 at the opposite ends of the support member 111 extends through spaced-apart notches or open slots 119 and 121 in the opposite side edges of the music sheet rest member 102 in a similar manner as the support member is attached releasably to the rest member 73. As a result, the music sheet rest member 102 is fixed to the triangular member 100, but the remaining parts of the stand 92 are readily disassembled and assembled in a similar manner as the stand 10, the stand 92 using fewer parts requiring assembly and disassembly.

What is claimed is:

1. An instrument support stand comprising, in combination:

a pair of L-shaped members constructed of flat, generally rigid material, each of said members having an elongated leg portion and an elongated foot portion extending from one end of the leg portion, said foot portion of each member having a flat surface on the side remote from the leg portion of the member adapted to rest upon a horizontal surface and said flat side of each of said members having a first slot extending therein generally normal to the flat side and confronting the leg portion of said member, each of said members having a second slot extending into the side of the foot portion thereof opposite the flat side and adjacent to the end of the foot portion opposite the leg portion thereof, and a third slot extending into the end of the leg portion remote from the foot portion, an elongated back strut having a first and a second slot extending therein from one side thereof and spaced from each other, said slots being disposed at an angle to the axis of the back strut and being closest to each other at the one side of the back strut, the first slot of one of the L-shaped members being aligned with the first slot of the back strut and engaging the back strut, and the first slot of the other of the L-shaped members being aligned with the second slot of the back strut and engaging the back strut, an elongated front strut having a first and a second slot extending therein from one side thereof and spaced from each other, said slots being disposed at an angle to the axis of the front strut and being farthest from each other at the one side of the front strut, the second slot of one of the L-shaped members being aligned with the first slot of the front strut and engaging the front strut, and the second slot of the other of the L-shaped members being aligned with the second slot of the front strut and engaging the front strut, and means for supporting the neck of a musical instrument including a depending flat strip having a first slot and a second slot extending therein from one side thereof and at a converging angle to said side thereof, the third slot of one of the L-shaped members being aligned with the one slot of the strip and engaging the strip, and the third slot of the other of the L-shaped members being aligned with the second slot of the strip and engaging the strip, whereby an instrument may be positioned on the foot portion of the L-shaped members between the leg portions thereof and the front strut, and the neck of the instrument engaged by the means therefor to support the instrument.

2. An instrument support stand comprising the combination of claim 1 wherein the means for supporting the neck of the musical instrument includes a support member for supporting sheet music in viewable position.

3. A stand comprising the combination of claim 1 in combination with a foot-rest, said foot-rest including a pivot rod mounted on and extending between the L-shaped members parallel to the axis of the front strut and adjacent to the intersection of the leg portion and foot portion of each of the L-shaped members, and a panel mounted on the pivot rod and pivotal with respect to the axis of said rod, said panel extending from the rod a distance greater than the distance between the rod and the front strut, whereby in one pivotal position the panel rests against the front strut to form a foot-rest and in another pivotal position the panel is substantially disposed between the leg portions of the L-shaped members.

4. A stand comprising the combination of claim 1 in combination with a generally horizontal foot-rest member and means for pivotally attaching the member between the L-shaped members, wherein said attaching means includes a pair of axially-aligned oppositely extending pivot rods at the rear end of said foot-rest member and a pair of aligned openings in said L-shaped members for receiving said rods to enable said foot-rest member to swing about the axis of said rods, said strut means including a front strut extending between said foot portions of said L-shaped members for receiving and supporting the front end portion of said foot-rest member, said L-shaped members each having a leg portion, said foot-rest member being disposed in a slightly rearwardly inclined disposition in its vertical position engaging the leg portions of said L-shaped members.

5. A stand comprising the combination of claim 1, wherein said means for supporting a musical instrument includes a flat rest member and a triangular member fixed to the rear face thereof, said triangular member having a notch in the bottom edge thereof, said upright member having a notch therein for receiving said notch in the bottom edge of said triangular member for attaching releasably said rest member on the upper portion of said upright member.

6. A stand adapted to support a musical instrument in at least a partially upright manner, comprising;

a pair of spaced-apart upright L-shaped members inclined toward one another, each one of said members having a forwardly projecting foot portion, the foot portions of said members extending in a substantially parallel spaced-apart manner for receiving and at least partially supporting the bottom portion of the musical instrument resting thereon;

strut means extending between the L-shaped members and releasably interconnecting them to help rigidify them; and support means releasably attached to the upper portion of at least one of the said L-shaped members for supporting the upper portion of the musical instrument, said support means including an upright member connected detachably to at least one of said L-shaped members, sheet music rest means being attached releasably on the upper portion of said upright member, said support means further including a support member connected detachably and transversely to said sheet music rest member, wherein said support means further includes a horizontal member releasably connected at its rear end to said upright member and projecting forwardly therefrom, said horizontal member having an enlarged front end, said front end having a notch for receiving and supporting the upper portion of the musical instrument, said sheet music rest means having a sheet music rest member detachably connected to said horizontal member.

* * * * *